US007021107B2

(12) United States Patent
Saegusa

(10) Patent No.: US 7,021,107 B2
(45) Date of Patent: Apr. 4, 2006

(54) BENDING PROCESSOR OF PIPE

(75) Inventor: Shigeru Saegusa, Sunto-gun (JP)

(73) Assignee: Usui Kokusai Sangyo Kaisha Limited, (JP)

( * ) Notice: Subject to any disclaimer, the term of this patent is extended or adjusted under 35 U.S.C. 154(b) by 253 days.

(21) Appl. No.: 10/736,088

(22) Filed: Dec. 15, 2003

(65) Prior Publication Data

US 2004/0139776 A1 Jul. 22, 2004

(30) Foreign Application Priority Data

Dec. 17, 2002 (JP) ..... 2002-364702

(51) Int. Cl.
*B21D 11/00* (2006.01)

(52) U.S. Cl. ..... 72/307; 72/306; 72/149; 72/151

(58) Field of Classification Search ..... 72/151, 72/153, 307, 306, 159
See application file for complete search history.

(56) References Cited

U.S. PATENT DOCUMENTS 5,765,426 A * 6/1998 Saegusa ..... 72/306
5,873,278 A * 2/1999 Saegusa ..... 72/306
6,434,995 B1 * 8/2002 Kataoka et al. ..... 72/307
6,591,655 B1 * 7/2003 Scheerschmidt ..... 72/307

FOREIGN PATENT DOCUMENTS

| | | |
|---|---|---|
| JP | 7-232219 | 9/1995 |
| JP | 8-29358 | 3/1996 |
| JP | 9-29346 | 2/1997 |
| JP | 9-308918 | 12/1997 |
| JP | 10-211524 | 8/1998 |

* cited by examiner

*Primary Examiner*—Derris H. Banks
*Assistant Examiner*—Debra M Wolfe
(74) *Attorney, Agent, or Firm*—Gerald E. Hespos; Anthony J. Casella

(57) ABSTRACT

A bending processor for a pipe has a pipe bending unit and a pipe twisting unit. The pipe bending unit is rotated by a predetermined angle while pressing the processed pipe against the circumferential face of a bending die, and performs the bending processing. The pipe bending unit may be movable in the longitudinal direction of the processed pipe or may be fixed. The pipe twisting unit is freely rotated by a predetermined angle with the center of the processed pipe as an axis. The pipe bending unit has a tensile bending function and a compression bending function.

3 Claims, 5 Drawing Sheets

BENDING PROCESSOR OF PIPE

TECHNICAL FIELD

The present invention relates to an efficient bending processor of a long pipe manufactured by a metal and constructed by a steel pipe, a stainless steel pipe, a copper pipe, a titanium pipe, an aluminum pipe, etc. and not particularly limited in outside diameter but having a relatively small diameter of about 25 mm or less.

BACKGROUND ART

For example, as shown in JP-B-8-29358, there is a double bending bender having two pressure die units on the left and right sides as the bending processor (bender device) of this kind. In this left-right double bending bender, a bending unit mechanism is set to a single structure, and is constructed so as to be freely raised and lowered with respect to a horizontal position in a gripping state of the long pipe. Further, a chuck mechanism portion is operated in association with the operation of a feed mechanism in the forward-backward direction on a moving base, and the moving base is constructed so as to be moved in parallel in the left-right direction.

As another pipe bending processor, there is a bending processor of the pipe for performing bending processings respectively set in respective set processing directions with respect to plural processed positions set in the axial direction of the pipe. The device of this kind has a pipe twisting unit and a pipe bending unit. In the pipe twisting unit, one end side of the processed pipe is chucked, the pipe is rotated with the axis as a center, a predetermined processing direction is set and the pipe is moved in the axial direction and set to a predetermined processing position. The pipe bending unit can be moved in the longitudinal direction of the processed pipe, clamps the processed pipe, rotates the processed pipe by a predetermined angle and performs the bending processing. This bending processor is generally called a CNC bender (see JP-B-8-29538, JP-A-7-232219, JP-A-9-29346, JP-A-9-308918, etc.).

DISCLOSURE OF INVENTION

However, in the above conventional pipe bending processor, the pipe bending unit is constructed by at least one bending die, a clamp jig and a reaction force receiving roller. The clamp jig performs the bending processing by rotating this clamp jig by a predetermined angle on the circumferential face of the bending die through the pipe while the processed pipe is pressed against the circumferential face of the bending die. In the case of this pipe bending unit, the bending die is used only in each bending direction. Therefore, the bending radius is limited and the reaction force receiving roller is not rotated and has no bending function with respect to the clamp jig rotated by the predetermined angle along the circumferential face of the bending die and performing the bending processing. Therefore, the bending processor is limited to only tensile bending (draw bend) and has no compression bending (compression bend) function for bending the pipe while the pipe is clamped (fixed) by the clamp jig. Therefore, in the case of the conventional device, the vibration of a twisting operation is increased in accordance with the bending angle and the twisting angle of the pipe so that an interference with the unit, etc. on the reaction force receiving roller side is generated. Accordingly, there is a case in which all the bending processes cannot be performed by one device. Therefore, the bending processings must be performed by using plural devices in accordance with products. Accordingly, there are defects that the number of processes must be increased and no bending processing time can be shortened.

Further, in the conventional device, a twisting time is required when the pipe twisting angle until obtaining the next bending plane after the pipe bending is large (when the pipe bending angle ranges from 90 degrees to 180 degrees). In particular, when the bending processing number is large and the pipe already performed with respect to the bending processing is long, the shape of the portion already bent is deformed when a pipe twisting speed is fast. Therefore, an error in the bending shape is caused. Therefore, the pipe must be twisted at low speed so that there is a defect that it takes much time to twist the pipe.

The present invention is made to dissolve the above defects of the conventional device, and its object is to provide a pipe bending processor in which one set of bending units has both the tensile bending (draw bend) function and the compression bending (compression bend) function and all the bending processes can be performed by one device.

A bending processor of a pipe in the present invention is characterized in that the bending processor comprises a pipe bending unit which has at least one bending die; a clamp jig for performing the bending processing by rotating this clamp jig by a predetermined angle on the circumferential face of the bending die through the pipe while pressing the processed pipe against the circumferential face of the bending die; and a reaction force receiving roller; and is a movable type movable in the longitudinal direction of the processed pipe, or is a fixing type; and the bending processor also comprises a pipe twisting unit freely moved by a predetermined angle with the center of the processed pipe as an axis and able to move the processed pipe to a position according to a bending shape; wherein the bending processor has both a tensile bending function and a compression bending function (a reverse bending function of the pipe) of the processed pipe by means of one bender by rotatably arranging the reaction force receiving roller of the above pipe bending unit in the same axis as the bending die and the clamp jig.

In the present invention, the unit for compression bending is rotatably arranged in the same axis as the unit for tensile bending, and the processed pipe can be reversely bent by the unit for compression bending so that the following large effects are obtained. Namely, the interference of the processed pipe and the bending processor is removed irrespective of the bending angle and the twisting angle of the pipe, and all the bending processes can be performed by one device, and the bending processing can be efficiently performed. Further, the bending processing of different radii and the bending processing of a long material are further performed with high accuracy and high efficiency. Further, even when the pipe twisting angle until obtaining the next bending plane after the pipe bending processing is large, the twisting angle is reduced by changing the bending system from the tensile bending system to the compression bending system (no twisting is required if the phase is 180 degrees) Thus, the bending plane of the next process is obtained in a short time, and the bending can be completed at high speed. Further, since no pipe is twisted at a large twisting angle, no shape of a portion already completed with respect to the bending processing is deformed. Therefore, the excellent effect of being able to perform exact bending processing having no error in the bending shape is obtained.

BEST MODE FOR CARRYING OUT THE INVENTION

Figure 1:
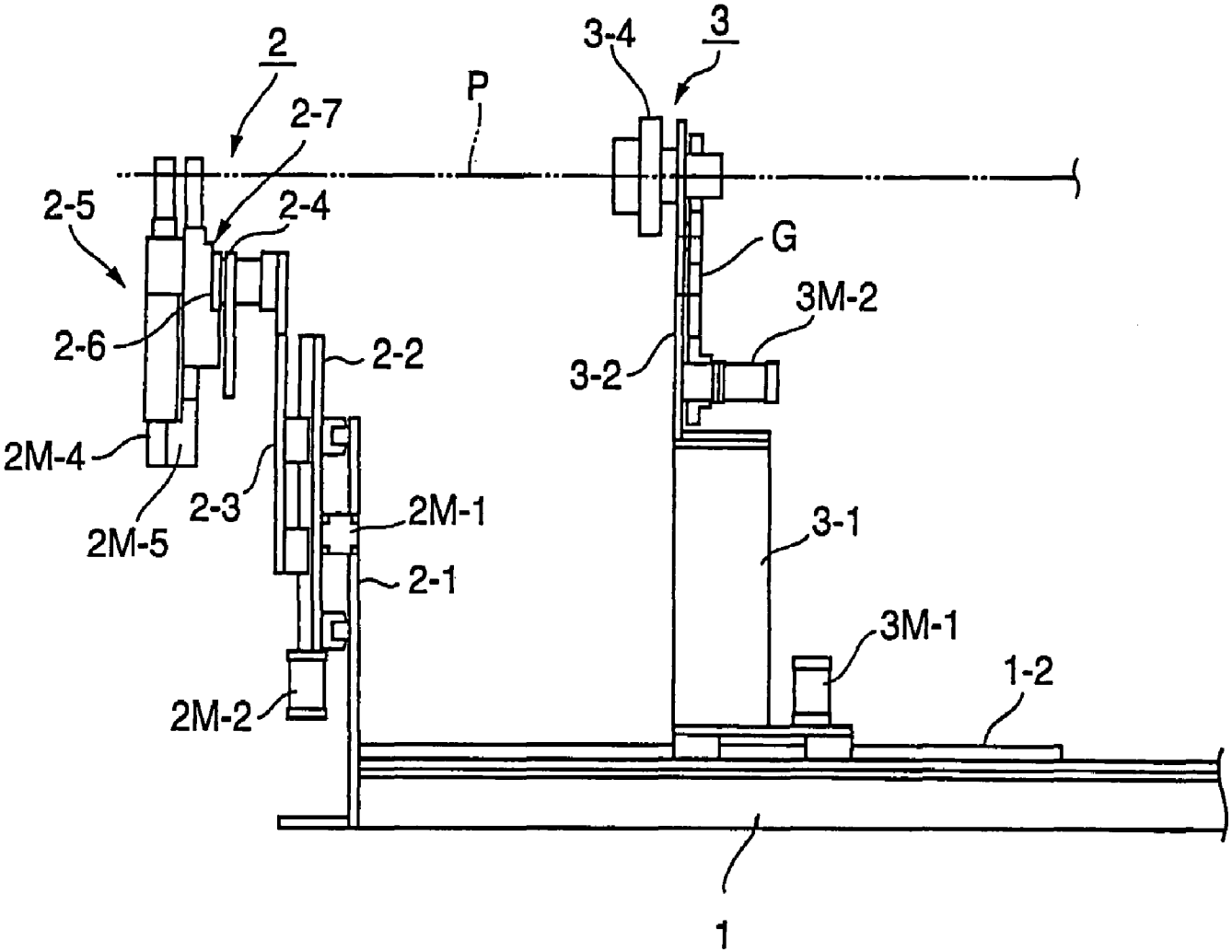
FIG. 1 is a schematic side view showing one embodiment of a pipe bending processor in the present invention.
Figure 2:
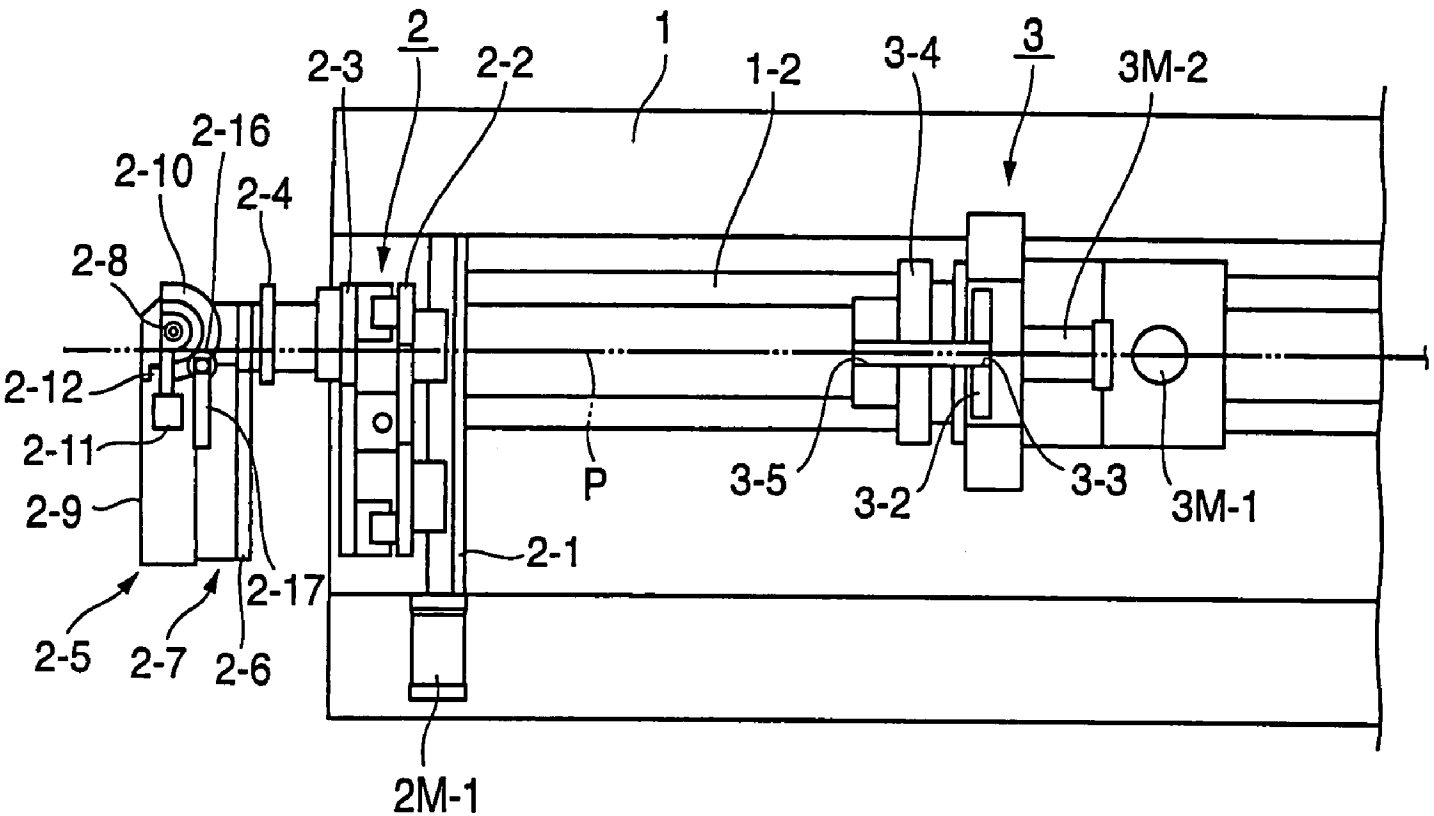
FIG. 2 is a schematic plan view of the above pipe bending processor.
Figure 3:
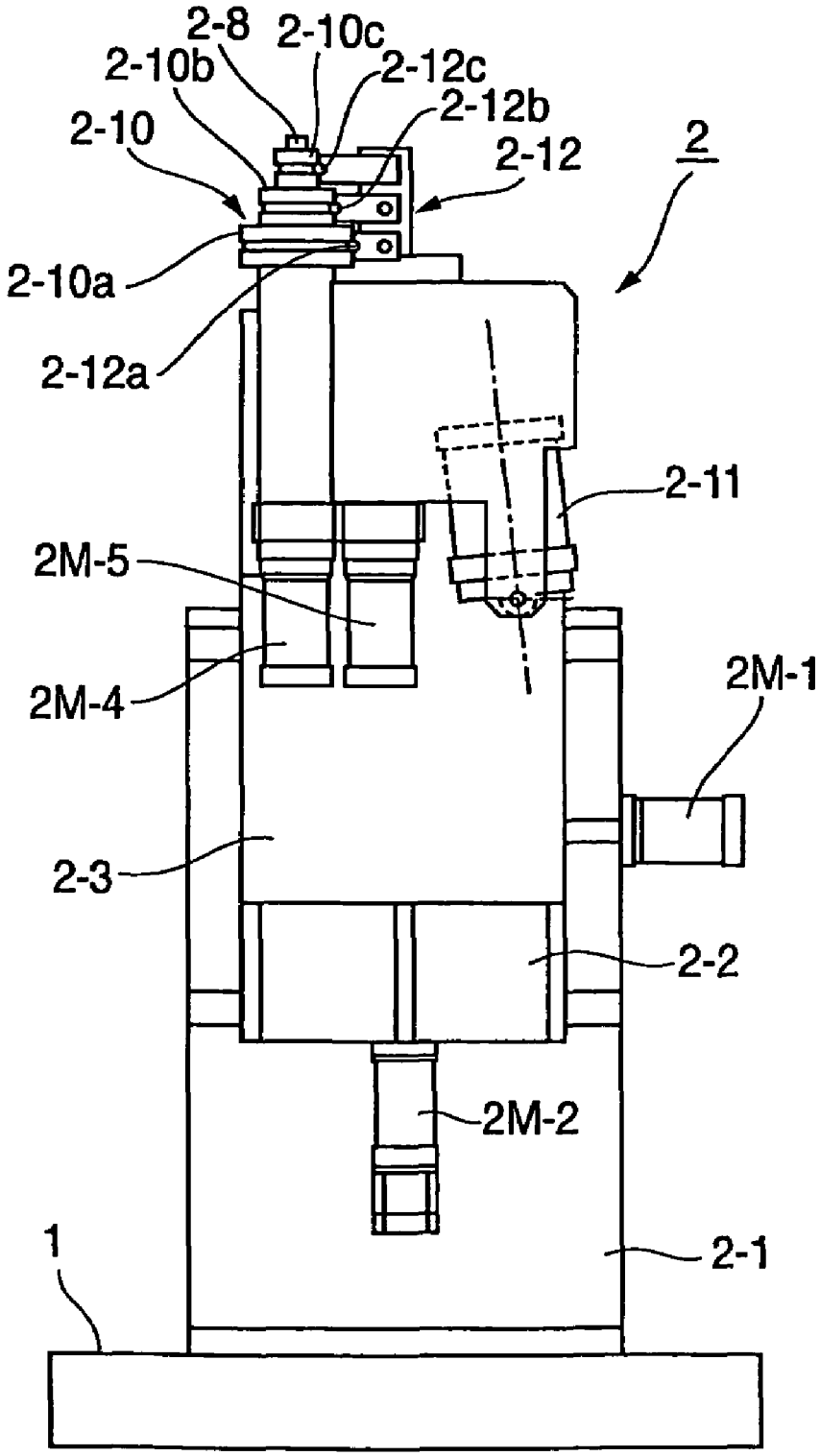
FIG. 3 is a schematic front view of the above pipe bending processor.
Figure 4:
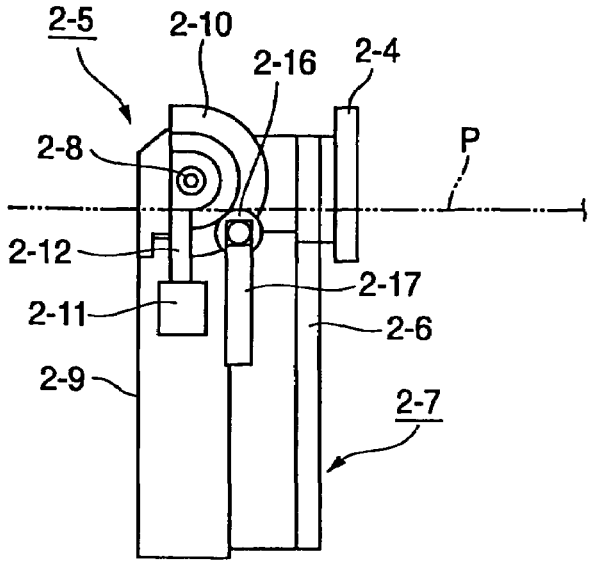
FIG. 4 is a schematic plan view showing a state just before a bending processing start at a tensile bending time (draw bend time) by using the above pipe bending processor.

In FIGS. 1 to 7, reference numerals 1, 2, 3 and P respectively designate a base, a pipe bending unit, a pipe twisting unit and a processed pipe which is a long pipe manufactured by a metal and constructed by a steel pipe, a stainless steel pipe, a copper pipe, a titanium pipe, an aluminum pipe, etc. and not particularly limited in outside diameter but having a small diameter of about ϕ25 mm or less.

Namely, the pipe bending processor in the present invention here illustrated is constructed by the pipe bending unit 2 and the pipe twisting unit 3 arranged on the base 1. The pipe bending unit 2 is fixedly arranged on the base 1, and the pipe twisting unit 3 is placed on the base 1 so as to be moved in the axial direction of the processed pipe P.

In the pipe bending unit 2, a support plate 2—2 is mounted to a fixing plate 2-1 rising on the base 1 so as to be moved leftward and rightward by a motor 2M-1 for a bending unit left-right movement. A movable plate 2-3 for supporting a bending unit mechanism is mounted to the support plate 2—2 so as to be vertically moved by a motor 2M-2 for a bending unit vertical movement. This bending unit mechanism is constructed by a bending arm unit 2-5 and a unit 2-7 for compression bending. The bending arm unit 2-5 is mounted to a unit base plate 2-4 for tensile bending fixed to the above movable plate 2-3. The unit 2-7 for compression bending is mounted to a unit base plate 2-6 for compression bending attached to the above movable plate 2-3 separately from the above bending unit base plate 2-4.

The bending arm unit 2-5 is constructed by a bending arm 2-9 rotatably attached to a support shaft 2-8, a bending die 2-10 integrally attached to the bending arm 2-9, a cylinder 2-11 for a pipe clamp, and a clamp jig 2-12. The bending arm 2-9 is mechanically constructed so as to be rotated with the support shaft 2-8 as a center by a motor 2M-4 for bending arm unit rotation attached to the bending unit base plate 2-4. Here, the bending die 2-10 is constructed by three die rolls 2-10*a* to 2-10*c* of different diameters. Further, the clamp jig 2-12 has clamp grooves 2-12*a*, 2-12*b*, 2-12*c* corresponding to the above bending die 2-10, and is attached so as to be moved in an arc shape in the direction perpendicular to the axis of the processed pipe P through a link mechanism built in the above bending arm 2-9. The clamp jig 2-12 is mechanically constructed such that its clamp operation is performed by the cylinder 2-11 for a pipe clamp attached to the bending arm 2-9.

On the other hand, the unit 2-7 for compression bending is constructed by the unit base plate 2-6 for compression bending rotatably attached to the same support shaft 2-8 as the above bending unit base plate 2-4, a reaction force receiving roller 2-16 arranged in this unit base plate 2-6, and a cylinder 2-17 for pressure. The unit base plate 2-6 for compression bending is mechanically constructed so as to be rotated with the above support shaft 2-8 as a center by a motor 2M-5 for bending attached to this unit base plate 2-6. The reaction force receiving roller 2-16 is arranged so as to correspond to the above bending die 2-10, and is mechanically constructed so as to be moved forward and backward by the cylinder 2-17 for pressure attached to the unit base plate 2-6 for compression bending.

Next, the pipe twisting unit 3 is placed on the upper face of the base 1 common to the pipe bending unit 2 so as to be moved in the axis direction of the processed pipe P, and is constructed so as to be moved forward and backward on a rail 1-2 in the longitudinal direction of the pipe by a drive motor 3M-1 for a twisting unit movement arranged in a unit main body 3-1. An engaging portion 3-3 is notched and formed in the unit main body 3-1, and the processed pipe P is engaged with the tip portion of a fixing plate 3-2 rising in the upper portion of the unit main body 3-1. A twisting plate 3-4 is integrally attached to this engaging portion 3-3, and a pipe chuck mechanism forming a notch 3-5 similar to the above notch therein is built in the twisting plate 3-4. The twisting plate 3-4 is mechanically rotated by a motor 3M-2 for twisting through a gear group G. Namely, the bending processor is constructed such that the processed pipe P is rotated by the motor 3M-2 for twisting and can be set to a predetermined angle.

When the bending processing of the processed pipe P is performed by the bending processor of the above construction, the processed pipe P supplied from a processed pipe carrying-in device (omitted in the drawings) is introduced into the engaging portion 3-3 of the tip portion of the fixing plate 3-2 of the pipe twisting unit 3 and the notch 3-5 of the twisting plate 3-4. When the processed pipe P is clamped by the pipe chuck mechanism (omitted in the drawings) built in the twisting plate 3-4, the pipe twisting unit 3 is moved by a predetermined amount on the bending unit side by the motor 3M-1 for a unit movement. At this time, the unit main body portion of the pipe bending unit 2 is lowered to a predetermined height position by the motor 2M-2 for a bending unit vertical movement. When the processed pipe P is moved and stopped in a predetermined position above the bending unit, the unit main body portion is simultaneously raised by the motor 2M-2 for a bending unit vertical movement and the bending die 2-10 is selected. Thus, the processed pipe P is clamped by the cylinder 2-11 for a pipe clamp and the clamp jig 2-12.

When one end side of the processed pipe P is held by the pipe bending unit 2 and the twisting unit 3 in this way, the twisting angle of the processed pipe P is set by the motor 3M-2 for twisting in the pipe twisting unit 3, and a bending processing operation is simultaneously started by the pipe bending unit 2.

Figure 5:
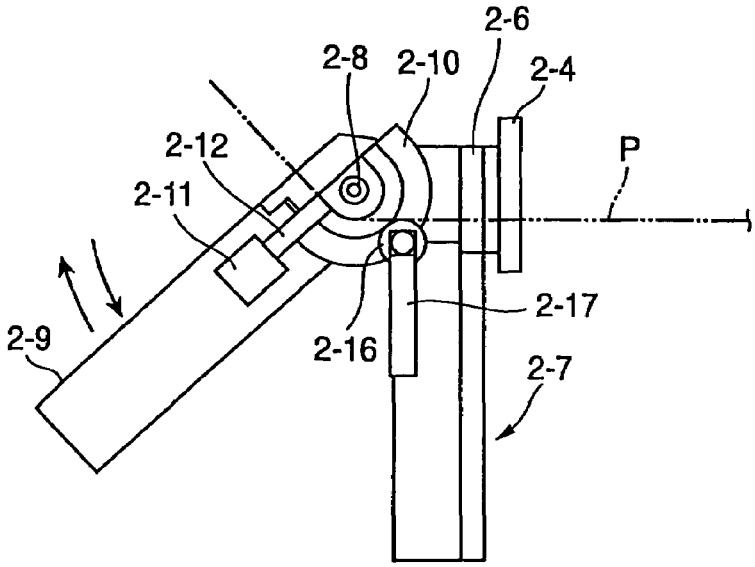
FIG. 5 is a schematic plan view showing a state during the bending processing at the tensile bending time (draw bend time).

This bending processing operation will next be explained on the basis of FIGS. 4 to 7. First, in the case of a tensile bending system (draw bend system), in the state just before the bending processing start shown in FIG. 4, the bending arm unit 2-5 is rotated by an assigned bending angle by the motor 2M-4 attached to the bending unit base plate 2-4. At this time, while the clamp jig 2-12 presses against the processed pipe P on the circumferential face of the bending die 2-10, the pipe twisting unit 3 is advanced in the longitudinal direction and moves this sent-out processed pipe P along the above circumferential face while pulling the processed pipe P by a predetermined angle, thereby performing the bending processing (FIG. 5). Predetermined tensile bending processing corresponding to the rotation angles of the bending die 2-10 and the clamp jig 2-12 is performed on one end side of the processed pipe P by this bending processing.

Figure 6:
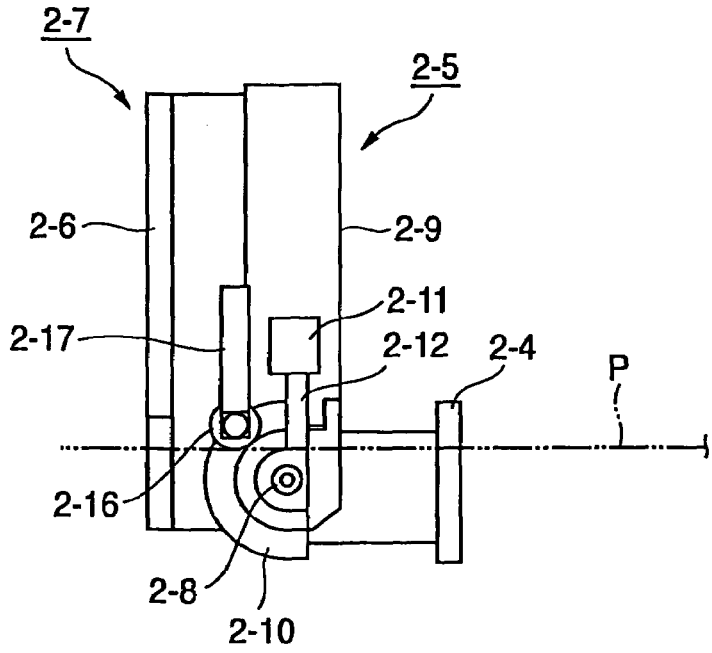
FIG. 6 is a schematic plan view showing a state just before the bending processing start at a compression bending time (compression bent time).
Figure 7:
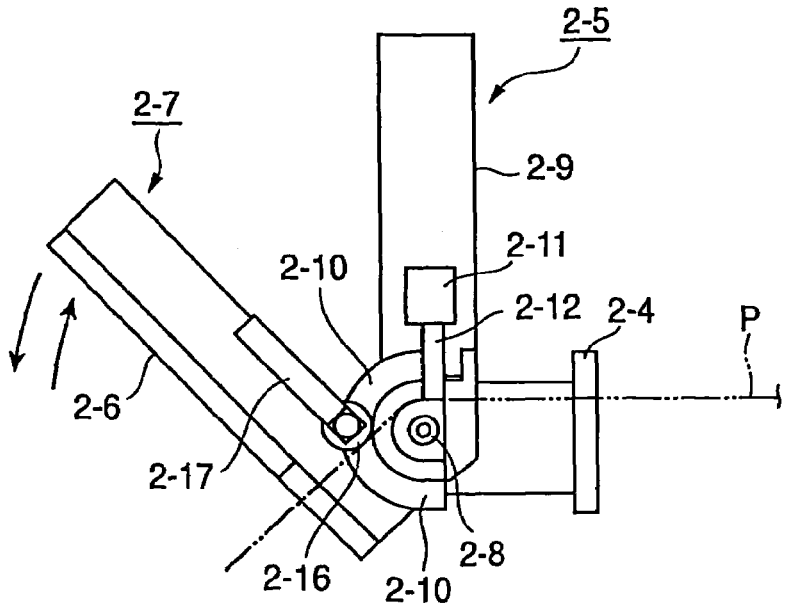
FIG. 7 is a schematic plan view showing a state during the bending process at the compression bending time (compression bend time).

Further, in the case of a compression bending system (compression bend system), as shown in FIG. 6, the bending arm unit 2-5 and the unit 2-7 for compression bending are rotated 180 degrees with the same support shaft 2-8 as a center by the respective motors 2M-4, 2M-5 for bending, and are located in the state shown in FIG. 6. Namely, in a state in which the processed pipe P is pressed against the bending die 2-10 by the clamp jig 2-12 and the cylinder 2-17 for pressure, the motor 2M-5 attached to the unit base 2-6 for compression bending is rotated by an assigned bending angle in the reverse direction. At this time, in a state in which the reaction force receiving roller 2-16 is abutted on the outer circumferential face of the processed pipe P, this processed pipe P is pressed against the circumferential face of the bending die 2-10 and is rotated by a predetermined angle so that the compression bending processing is performed.

The pipe bending processor of the present invention is constructed such that the bending processing position and the twisting angle of the processed pipe P, the moving amount of the twisting unit, etc. are inputted to an automatic controller (omitted in the drawings) in advance, and the bending processing with respect to the processed pipe is entirely automatically performed.

INDUSTRIAL APPLICABILITY

In the present invention, as mentioned above, the interference of the processed pipe and the bending processor is removed irrespective of the bending angle and the twisting angle of the processed pipe, and all the bending processes can be performed by one device, and the bending processing can be efficiently performed. Further, the bending processing of different radii and the bending processing of a long material are further performed with high accuracy and high efficiency. Further, even when the pipe twisting angle until obtaining the next bending plane after the pipe bending processing is large, the twisting angle is reduced by changing the bending system from the tensile bending system to the compression bending system (no twisting is required if the phase is 180 degrees). Thus, the bending plane of the next process is obtained in a short time, and the bending can be completed at high speed. Further, since no pipe is twisted at a large twisting angle, no shape of a portion already completed with respect to the bending processing is deformed. Therefore, it is possible to perform exact bending processing having no error in the bending shape. The present invention relates to an efficient bending processor of a long pipe manufactured by a metal and constructed by a steel pipe, a stainless steel pipe, a copper pipe, a titanium pipe, an aluminum pipe, etc. and having a small outside diameter of about 25 mm or less.

What is claimed is:

1. A bending processor of a pipe comprising a pipe bending unit which has at least one bending die; a clamp jig for performing the bending processing by rotating this clamp jig by a predetermined angle on the circumferential face of the bending die through the pipe while pressing the processed pipe against the circumferential face of the bending die; and a reaction force receiving roller; and is a movable type movable in the longitudinal direction of the processed pipe, or is a fixing type; and also comprising a pipe twisting unit freely moved by a predetermined angle with the center of the processed pipe as an axis and able to move the processed pipe to a position according to a bending shape; wherein the bending processor has a tensile bending function and a compression bending function of the processed pipe by rotatably arranging the reaction force receiving roller of said pipe bending unit in the same axis as the bending die and the clamp jig.

2. The pipe bending processor according to claim 1, wherein said processed pipe is constructed by a steel pipe, a stainless steel pipe, a copper pipe, a titanium pipe or an aluminum pipe.

3. The pipe bending processor according to claim 1, wherein said processed pipe has a small outside diameter of about 25 mm or less.

* * * * *